US012012567B2

(12) United States Patent
Matsubara

(10) Patent No.: US 12,012,567 B2
(45) Date of Patent: Jun. 18, 2024

(54) LUBRICATING OIL COMPOSITION

(71) Applicant: Idemitsu Kosan Co., Ltd., Chiyoda-ku (JP)

(72) Inventor: Kazushige Matsubara, Chiba (JP)

(73) Assignee: Idemitsu Kosan Co., Ltd., Chiyoda-ku (JP)

( * ) Notice: Subject to any disclaimer, the term of this patent is extended or adjusted under 35 U.S.C. 154(b) by 118 days.

(21) Appl. No.: 17/627,081

(22) PCT Filed: Jul. 9, 2020

(86) PCT No.: PCT/JP2020/026779
§ 371 (c)(1),
(2) Date: Jan. 13, 2022

(87) PCT Pub. No.: WO2021/010265
PCT Pub. Date: Jan. 21, 2021

(65) Prior Publication Data

US 2022/0275303 A1 Sep. 1, 2022

(30) Foreign Application Priority Data

Jul. 18, 2019 (JP) ..... 2019-132914

(51) Int. Cl.

| | |
|---|---|
| ***C10M 169/04*** | (2006.01) |
| ***C10M 133/16*** | (2006.01) |
| ***C10M 137/10*** | (2006.01) |
| ***C10M 141/10*** | (2006.01) |
| *C10N 30/00* | (2006.01) |
| *C10N 30/02* | (2006.01) |
| *C10N 30/06* | (2006.01) |

(52) U.S. Cl.
CPC ..... *C10M 169/04* (2013.01); *C10M 133/16* (2013.01); *C10M 137/10* (2013.01); *C10M 141/10* (2013.01); *C10M 2203/003* (2013.01); *C10M 2215/28* (2013.01); *C10M 2223/045* (2013.01); *C10N 2030/02* (2013.01); *C10N 2030/06* (2013.01); *C10N 2030/54* (2020.05)

(58) Field of Classification Search
CPC ..... C10M 169/04; C10M 133/16; C10M 137/10; C10M 141/10; C10M 2203/003; C10M 2215/28; C10M 2223/045; C10N 2030/02; C10N 2030/06; C10N 2030/54; C10N 2040/04; C10N 2040/042; C10N 2040/044; C10N 2040/045; C10N 2040/046
USPC ..... 508/514
See application file for complete search history.

(56) References Cited

U.S. PATENT DOCUMENTS

| | | | | |
|---|---|---|---|---|
| 4,808,335 | A * | 2/1989 | Sung | C10M 133/16 508/242 |
| 5,599,779 | A * | 2/1997 | Karol | C10M 133/06 508/514 |
| 9,120,992 | B2 | 9/2015 | Nakao et al. | |
| 2005/0096236 | A1* | 5/2005 | Le Sausse | C10M 137/105 508/439 |
| 2005/0181958 | A1* | 8/2005 | Carey | C10M 169/04 508/514 |
| 2008/0058235 | A1 | 3/2008 | Takigawa et al. | |
| 2012/0051965 | A1* | 3/2012 | Choudhary | C10M 141/06 508/513 |
| 2013/0345103 | A1 | 12/2013 | Nakao et al. | |
| 2018/0023026 | A1 | 1/2018 | Kusuhara | |
| 2020/0270544 | A1* | 8/2020 | Plancq | C10M 125/24 |

FOREIGN PATENT DOCUMENTS

| | | | |
|---|---|---|---|
| CN | 103805322 | A | 5/2014 |
| CN | 109337745 | A | 2/2019 |
| EP | 2 746 374 | A2 | 6/2014 |
| GB | 1235896 | | 6/1971 |
| GB | 1331586 | | 9/1973 |
| JP | 2005-290181 | A | 10/2005 |
| JP | 2012-193255 | A | 10/2012 |
| JP | 2016-148004 | A | 8/2016 |

OTHER PUBLICATIONS

Extended European Search Report dated Dec. 16, 2022 in European Patent Application No. 20840135.6, 7 pages.
International Search Report dated Sep. 24, 2020 in PCT/JP2020/026779 filed Jul. 9, 2020, 2 pages.

* cited by examiner

*Primary Examiner* — Ellen M McAvoy
(74) *Attorney, Agent, or Firm* — Oblon, McClelland, Maier & Neustadt, L.L.P.

(57) ABSTRACT

A lubricating oil composition comprising a base oil, a zinc dialkyldithiophosphate, and a sarcosine derivate is described. The lubricating oil composition may comprise the zinc dialkyldithiophosphate at a concentration of 0.10 to 10 mass % and the sarcosine derivate at a concentration of 0.01 to 5.0 mass %. The lubricating oil composition may have a kinematic viscosity at 100° C. of 6.5 $mm^2/s$ or less, and can be used for lubricating a speed reducer.

20 Claims, No Drawings

LUBRICATING OIL COMPOSITION

CROSS-REFERENCE TO RELATED APPLICATIONS

The present application is the national stage of international application PCT/JP2020/026779, filed on Jul. 9, 2020, and claims the benefit of the filing date of Japanese Appl. No. 2019-132914, filed on Jul. 18, 2019.

TECHNICAL FIELD

The present invention relates to a lubricating oil composition.

BACKGROUND ART

Various apparatuses such as an engine, a transmission, a speed reducer, a compressor and a hydraulic system have mechanisms such as a torque converter, a wet clutch, a gear bearing mechanism, an oil pump and a hydraulic control mechanism. In these mechanisms, lubricating oil compositions are used, and lubricating oil compositions capable of meeting various requirements have been developed.

For example, Patent Literature 1 discloses a gear oil composition comprising: a base oil comprising a blend of a low-viscosity mineral oil-based lubricating base oil and a high-viscosity solvent-refined mineral oil-based lubricating oil in a specific ratio; and a zinc dialkyldithiophosphate and an alkaline earth metal-based detergent in predetermined amounts, for the purpose of providing a gear oil composition having a fuel saving performance and providing gears, bearings, etc. with sufficient durability.

CITATION LIST

Patent Literature

Patent Literature 1: JP-A-2012-193255

SUMMARY OF INVENTION

Technical Problem

Under such circumstances, a novel lubricating oil composition suitable for various mechanisms incorporated in apparatuses has been desired.

Solution to Problem

The present invention provides a lubricating oil composition comprising a base oil, a zinc dialkyldithiophosphate, and a sarcosine derivative, and more specifically provides lubricating oil compositions, use of a lubricating oil composition, and a method for producing a lubricating oil composition according to the following embodiments [1] to [11].

[1] A lubricating oil composition comprising a base oil (A), a zinc dialkyldithiophosphate (B), and a sarcosine derivative (C).

[2] The lubricating oil composition according to the above [1], wherein a kinematic viscosity of the lubricating oil composition at 100° C. is 6.5 $mm^2/s$ or less.

[3] The lubricating oil composition according to the above [1] or [2], wherein a content of the component (B) is 0.10 to 10 mass % based on the total amount of the lubricating oil composition.

[4] The lubricating oil composition according to any one of the above [1] to [3], wherein a content of the component (C) is 0.01 to 5.0 mass % based on the total amount of the lubricating oil composition.

[5] The lubricating oil composition according to any one of the above [1] to [4], wherein a content ratio by mass of the component (B) to the component (C), [(B)/(C)], is 1.0 to 10.0.

[6] The lubricating oil composition according to any one of the above [1] to [5], wherein the component (B) is a compound represented by the following general formula (b-1):

(b-1)

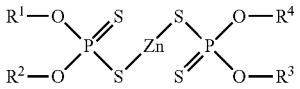

wherein $R^1$ to $R^4$ are each independently a hydrocarbon group.

[7] The lubricating oil composition according to the above [6], wherein at least one of $R^1$ to $R^4$ in the general formula (b-1) is a group represented by the following general formula (i) or (ii):

(i)

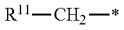

(ii)

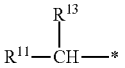

wherein $R^{11}$ to $R^{13}$ are each independently an alkyl group, and * represents a bonding position to an oxygen atom in the formula (b-1).

[8] The lubricating oil composition according to any one of the above [1] to [7], wherein the component (C) is a compound represented by the following general formula (c-1):

(c-1)

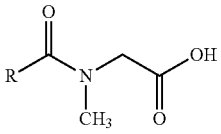

wherein R is a hydrocarbon group having 6 to 30 carbon atoms.

[9] The lubricating oil composition according to the above [8], wherein R in the general formula (c-1) is an alkyl group having 6 to 30 carbon atoms or an alkenyl group having 6 to 30 carbon atoms.

[10] The lubricating oil composition according to any one of the above [1] to [9], being used for lubrication of a speed reducer.

[11] Use of a lubricating oil composition, wherein a lubricating oil composition comprising a base oil (A), a zinc dialkyldithiophosphate (B), and a sarcosine derivate (C) is applied to lubrication of a speed reducer.

[12] A method for producing a lubricating oil composition, comprising a step of adding a zinc dialkyldithiophosphate (B) and a sarcosine derivative (C) to a base oil (A).

Advantageous Effects of Invention

The lubricating oil composition of one preferred embodiment of the present invention is a lubricating oil composition having characteristics suitable for various mechanisms incorporated in apparatuses, and the lubricating oil composition of a more preferred embodiment of the present invention has good fuel saving properties and is excellent in seizure resistance and wear resistance. On that account, these lubricating oil compositions can be preferably used for lubrication of a speed reducer, etc.

DESCRIPTION OF EMBODIMENTS

Regarding the numerical range described in the present specification, the upper limit and the lower limit can be arbitrarily combined. For example, with the description "preferably 30 to 100, more preferably 40 to 80" as a numerical range, the range of "30 to 80" and the range of "40 to 100" are also included in the numerical range described in the present specification. Alternatively, for example, with the description "preferably 30 or more, more preferably 40 or more, and preferably 100 or less, more preferably 80 or less" as a numerical range, the range of "30 to 80" and the range of "40 to 100" are also included in the numerical range described in the present specification.

In addition, for example, the description of "60 to 100" as the numerical range described in the present specification means a range of "60 or more and 100 or less".

[Constitution of Lubricating Oil Composition]

The lubricating oil composition of the present invention comprises a base oil (A), a zinc dialkyldithiophosphate (also referred to as "ZnDTP" hereinafter) (B), and a sarcosine derivative (C).

In the lubricating oil composition of the present invention, ZnDTP of the component (B) mainly contributes to improvement in seizure resistance, and the sarcosine derivative of the component (C) mainly contributes to improvement in wear resistance. In the lubricating oil composition of the present invention, by using the component (B) and the component (C) in combination, a synergistic effect of improving seizure resistance and wear resistance is obtained, and these can be improved in a balanced manner, and as a result, fuel saving properties can be improved.

If the viscosity of a lubricating oil composition is lowered, the fuel saving properties are generally improved with the viscosity lowering, but a problem of reduction of seizure resistance and wear resistance occurs.

On the other hand, in the lubricating oil composition of one embodiment of the present invention, by using the component (B) and the component (C) in combination, the seizure resistance and the wear resistance can be improved even if the viscosity of the lubricating oil composition is lowered, and it becomes possible to also enjoy the effect of improving fuel saving properties of the lubricating oil composition due to the viscosity lowering.

In the lubricating oil composition of one embodiment of the present invention, the content ratio by mass of the component (B) to the component (C), [(B)/(C)], is preferably 1.0 to 10.0, more preferably 1.4 to 8.0, still more preferably 1.8 to 7.0, still much more preferably 2.2 to 6.0, and particularly preferably 2.5 to 5.0, from the viewpoint of synergistically improving seizure resistance and wear resistance and thereby obtaining a lubricating oil composition having an excellent balance between the two.

The lubricating oil composition of one embodiment of the present invention preferably further contains one or more additives selected from an ashless dispersant, a metal-based detergent, a sulfur-based extreme pressure agent, a viscosity index improver, an antioxidant, and an anti-foaming agent.

The lubricating oil composition of one embodiment of the present invention may further contain various additives other than the components (B) to (C) and the above-mentioned additives when needed as long as the effects of the present invention are not impaired.

In the lubricating oil composition of one embodiment of the present invention, the total content of the components (A), (B) and (C) is preferably 60 mass % or more, more preferably 65 mass % or more, still more preferably 70 mass % or more, still much more preferably 75 mass % or more, and particularly preferably 80 mass % or more, and is usually 100 mass % or less, based on the total amount (100 mass %) of the lubricating oil composition, but taking the contents of the components other than the components (A) to (C) into consideration, it may be 99.0 mass % or less, 98.0 mass % or less, 97.5 mass % or less, or 95.0 mass % or less.

Details of the components contained in the lubricating oil composition of one embodiment of the present invention will be described hereinafter.

<Component (A): Base Oil>

As the base oil that is the component (A) used in one embodiment of the present invention, one or more selected from mineral oils and synthetic oils can be mentioned.

Examples of the mineral oils include atmospheric residues obtained by subjecting crude oils, such as paraffinic crude oil, intermediate base crude oil and naphthenic crude oil, to atmospheric distillation; distillates obtained by subjecting these atmospheric residues to vacuum distillation; and refined oils obtained by subjecting the distillates to one or more of refining treatments, such as solvent deasphalting, solvent extraction, hydrocracking, solvent dewaxing, catalytic dewaxing, and hydrorefining (hydrocracking).

Examples of the synthetic oils include poly-α-olefins, such as an α-olefin homopolymer and an α-olefin copolymer (for example, an a-olefin copolymer having 8 to 14 carbon atoms such as an ethylene-α-olefin copolymer); isoparaffin; polyalkylene glycol; ester oils, such as polyol ester, dibasic acid ester, and phosphoric acid ester; ether oils, such as polyphenyl ether; alkylbenzene; alkylnaphthalene; and synthetic oil (GTL) obtained by isomerizing wax (GTL WAX (Gas To Liquids WAX)) produced from natural gas through Fischer-Tropsch process or the like.

The component (A) used in one embodiment of the present invention is preferably one or more selected from mineral oils classified in Group II and Group III of API (American Petroleum Institute) base oil categories, and synthetic oils.

The kinematic viscosity of the component (A) used in one embodiment of the present invention at 100° C. is preferably 1.5 $mm^2/s$ or more, more preferably 1.8 $mm^2/s$ or more, still more preferably 2.0 $mm^2/s$ or more, and still much more preferably 2.2 $mm^2/s$ or more, from the viewpoint of suppressing evaporation loss, and it is preferably 6.5 $mm^2/s$ or less, more preferably 6.0 $mm^2/s$ or less, still more preferably 5.7 $mm^2/s$ or less, still much more preferably 5.4 $mm^2/s$ or less, and particularly preferably 5.0 $mm^2/s$ or less, from the viewpoint of obtaining a lubricating oil composition excellent in fuel saving properties.

The viscosity index of the component (A) used in one embodiment of the present invention is preferably 70 or more, more preferably 80 or more, still more preferably 90 or more, and still much more preferably 100 or more.

In the present specification, the kinematic viscosity and the viscosity index mean values measured and calculated in accordance with JIS K2283:2000.

When a mixed oil that is a combination of two or more base oils is used as the component (A) in one embodiment of the present invention, the kinematic viscosity and the viscosity index of the mixed oil are preferably in the above ranges. On that account, by using a low-viscosity base oil and a high-viscosity base oil in combination, the mixed oil may be prepared so as to have a kinematic viscosity and a viscosity index in the above ranges.

In the lubricating oil composition of one embodiment of the present invention, the content of the component (A) is preferably 50 to 99.89 mass %, more preferably 60 to 99.0 mass %, still more preferably 65 to 97.0 mass %, and still much more preferably 70 to 95.0 mass %, based on the total amount (100 mass %) of the lubricating oil composition.

<Component (B): Zinc dialkyldithiophosphate>

The lubricating oil composition of the present invention contains, as an anti-wear agent, a zinc dialkyldithiophosphate (ZnDTP) that is the component (B). The component (B) may be used singly, or may be used in combination of two or more.

From the viewpoint of obtaining a lubricating oil composition having been more improved in seizure resistance, the component (B) used in one embodiment of the present invention is preferably a compound represented by the following general formula (b-1).

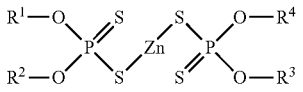

(b-1)

In the formula (b-1), $R^1$ to $R^4$ are each independently a hydrocarbon group, and the hydrocarbon groups may be the same as one another or may be different from one another.

The number of carbon atoms of the hydrocarbon group capable of being selected as $R^1$ to $R^4$ is preferably 1 to 20, more preferably 1 to 16, still more preferably 3 to 12, and still much more preferably 3 to 10.

Examples of the hydrocarbon groups capable of being selected as $R^1$ to $R^4$ include alkyl groups, such as a methyl group, an ethyl group, a propyl group (n-propyl group, isopropyl group), a butyl group (n-butyl group, s-butyl group, t-butyl group, isobutyl group), a pentyl group, a hexyl group, a heptyl group, an octyl group, a 2-ethylhexyl group, a nonyl group, a decyl group, an undecyl group, a dodecyl group, a tridecyl group, a tetradecyl group, a pentadecyl group, a hexadecyl group, a heptadecyl group and an octadecyl group; alkenyl groups, such as an octenyl group, a nonenyl group, a decenyl group, an undecenyl group, a dodecenyl group, a tridecenyl group, a tetradecenyl group and a pentadecenyl group; cycloalkyl groups, such as a cyclohexyl group, a dimethylcyclohexyl group, an ethylcyclohexyl group, a methylcyclohexylmethyl group, a cyclohexylethyl group, a propylcyclohexyl group, a butylcyclohexyl group and a heptylcyclohexyl group; aryl groups, such as a phenyl group, a naphthyl group, an anthracenyl group, a biphenyl group and a terphenyl group; alkylaryl groups, such as a tolyl group, a dimethylphenyl group, a butylphenyl group, a nonylphenyl group, a methylbenzyl group and a dimethylnaphthyl group; and arylalkyl groups, such as a phenylmethyl group, a phenylethyl group and a diphenylmethyl group.

Among these, preferable are alkyl groups, and more preferable are primary or secondary alkyl groups, as the hydrocarbon groups capable of being selected as $R^1$ to $R^4$. The alkyl group may be a straight-chain alkyl group or may be a branched chain alkyl group.

In one embodiment of the present invention, it is preferable that at least one of $R^1$ to $R^4$ in the general formula (b-1) be a group represented by the following general formula (i) or (ii), and it is more preferable that all of $R^1$ to $R^4$ be groups represented by the following general formula (i) or (ii).

It is more preferable that at least one of $R^1$ to $R^4$ in the general formula (b-1) be a group represented by the following general formula (ii), and it is still more preferable that all of $R^1$ to $R^4$ be groups represented by the following general formula (ii).

$$R^{11}-CH_2-* \quad \text{(i)}$$

$$R^{11}-\underset{}{\overset{R^{13}}{\overset{|}{CH}}}-* \quad \text{(ii)}$$

In the formulae (i) and (ii), $R^{11}$ to $R^{13}$ are each independently an alkyl group. * represents a bonding position to an oxygen atom in the formula (b-1).

The number of carbon atoms of the alkyl group capable of being selected as $R^{11}$ and the total number of carbon atoms of the alkyl groups capable of being selected as $R^{12}$ and $R^{13}$ are each preferably 1 to 19, more preferably 1 to 15, still more preferably 2 to 11, and still much more preferably 2 to 9.

Examples of the alkyl groups capable of being selected as $R^{11}$ to $R^{13}$ include alkyl groups that are the same as the aforementioned alkyl groups capable of being selected as $R^1$ to $R^4$. The alkyl group may be a straight-chain alkyl group or may be a branched chain alkyl group.

In the lubricating oil composition of one embodiment of the present invention, the content of the component (B) is preferably 0.10 to 10 mass %, more preferably 0.50 to 8.0 mass %, still more preferably 0.80 to 6.0 mass %, still much more preferably 1.0 to 5.0 mass %, and particularly preferably 1.3 to 4.0 mass %, based on the total amount (100 mass %) of the lubricating oil composition, from the viewpoint of obtaining a lubricating oil composition having been more improved in both of seizure resistance and wear resistance.

In the lubricating oil composition of one embodiment of the present invention, the content of the component (B) in terms of zinc atoms is preferably 0.01 to 1.0 mass %, more preferably 0.05 to 0.80 mass %, still more preferably 0.08 to 0.60 mass %, still much more preferably 0.10 to 0.50 mass %, and particularly preferably 0.12 to 0.40 mass %, based on the total amount (100 mass %) of the lubricating oil composition, from the same viewpoint as above.

In the present specification, the content of zinc atoms means a value measured in accordance with JPI-5S-38-92.

<Component (C): Sarcosine Derivative>

The lubricating oil composition of the present invention contains, as an oily agent, a sarcosine derivative that is the component (C). The component (C) may be used singly, or may be used in combination of two or more.

In the present specification, the sarcosine derivatives include a sarcosine-derived compound having a structure represented by the following formula (c-0) and its salt.

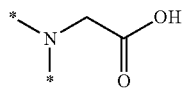

(c-0)

wherein * represents a bonding position to a hydrogen atom or a substituent.

The component (C) used in one embodiment of the present invention is preferably an N-acyl sarcosine derivative having a structure in which a nitrogen atom in the formula (c-0) is bonded to an acyl group, and is more preferably a compound represented by the following general formula (c-1), from the viewpoint of obtaining a lubricating oil composition having been more improved in wear resistance.

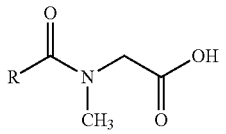

(c-1)

In the formula (c-1), R is a hydrocarbon group having 6 to 30 carbon atoms.

The hydrocarbon is preferably an alkyl group having 6 to 30 carbon atoms, a cycloalkyl group having 6 to 30 carbon atoms, or an alkenyl group having 6 to 30 carbon atoms, it is more preferably an alkyl group having 6 to 30 carbon atoms or an alkenyl group having 6 to 30 carbon atoms, and it is still more preferably an alkenyl group having 6 to 30 carbon atoms.

Examples of the alkyl groups capable of being selected as R include a hexyl group, a heptyl group, an octyl group, a 2-ethylhexyl group, a nonyl group, a decyl group, an undecyl group, a dodecyl group, a tridecyl group, a tetradecyl group, a hexadecyl group, an octadecyl group, a tetracosyl group, and a hexacosyl group.

The alkyl group may be a straight-chain alkyl group or may be a branched chain alkyl group, but it is preferably a straight-chain alkyl group.

The number of carbon atoms of the alkyl group is 6 to 30, but is preferably 8 to 26, more preferably 10 to 24, and still more preferably 12 to 20.

Examples of the cycloalkyl groups capable of being selected as R include a cyclohexyl group, a cyloheptyl group, a cyclooctyl group and an adamantyl group, and at least one hydrogen in these may be substituted by an alkyl group having 1 to 10 (preferably 1 to 4) carbon atoms.

The number of carbon atoms of the cycloalkyl group (in the case of a cycloalkyl group substituted by an alkyl group, the number of carbon atoms of this alkyl group is also included) is 6 to 30, but is preferably 6 to 26, more preferably 6 to 20, and still more preferably 6 to 15.

Examples of the alkenyl groups capable of being selected as R include a hexenyl group, a heptenyl group, an octenyl group, a nonenyl group, a decenyl group, an undecenyl group, a dodecenyl group, a tridecenyl group, a tetradecenyl group, a hexadecenyl group, an octadecenyl group (oleyl group), a tetracosenyl group, and a hexacosenyl group.

The alkenyl group may be a straight-chain alkenyl group or may be a branched chain alkenyl group, but it is preferably a straight-chain alkenyl group.

The number of carbon atoms of the alkenyl group is 6 to 30, but is preferably 8 to 26, more preferably 10 to 24, and still more preferably 12 to 20.

Specific examples of the components (C) used in one embodiment of the present invention include sarcosine, N-lauryl sarcosine, N-oleyl sarcosine, N-lauroyl sarcosine, N-oleoyl sarcosine, N-myristoyl sarcosine, N-palmitoyl sarcosine, N-stearoyl sarcosine, undecanoyl sarcosine, tridecanoyl sarcosine, and pentadecanoyl sarcosine.

In the lubricating oil composition of one embodiment of the present invention, the content of the component (C) is preferably 0.01 to 5.0 mass %, more preferably 0.05 to 4.0 mass %, still more preferably 0.10 to 3.0 mass %, still much more preferably 0.20 to 2.0 mass %, and particularly preferably 0.25 to 1.5 mass %, based on the total amount (100 mass %) of the lubricating oil composition, from the viewpoint of obtaining a lubricating oil composition having been more improved in both of seizure resistance and wear resistance.

<Oily Agent Other than Component (C)>

The lubricating oil composition of one embodiment of the present invention may further contain other oily agents than the component (C) as long as the effects of the present invention are not impaired.

Examples of other oily agents than the component (C) include polymers of polymerized fatty acids, such as a dimer acid and a hydrogenated dimer acid; aliphatic saturated or unsaturated monoalcohols, such as lauryl alcohol and oleyl alcohol; aliphatic saturated or unsaturated monoamines, such as stearylamine and oleylamine; and aliphatic saturated or unsaturated monocarboxylic acid amides, such as lauric acid amide and oleic acid amide.

In the lubricating oil composition of one embodiment of the present invention, however, the content of such other oily agents is preferably smaller from the viewpoint of favorably maintaining seizure resistance and wear resistance of the lubricating oil composition having been decreased in viscosity.

Specifically, the content of other oily agents than the component (C) is preferably 0 to 20 parts by mass, more preferably 0 to 10 parts by mass, still more preferably 0 to 1 part by mass, still much more preferably 0 to 0.1 part by mass, and particularly preferably 0 to 0.01 part by mass, based on 100 parts by mass of the total amount of the component (C) contained in the lubricating oil composition.

<Ashless Dispersant>

From the viewpoint of improving dispersibility of the component (B) and the component (C), the lubricating oil composition of one embodiment of the present invention may further contain an ashless dispersant. The ashless dispersant may be used singly, or may be used in combination of two or more.

The ashless dispersant used in one embodiment of the present invention is preferably an alkenyl succinimide, and examples thereof include an alkenyl bis-succinimide represented by the following general formula (d-1) and an alkenyl monosuccinimide represented by the following general formula (d-2).

(d-1)

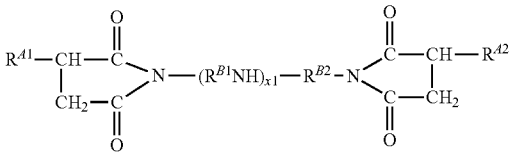

(d-2)

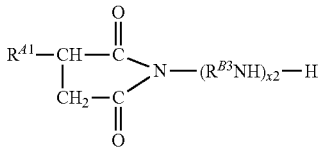

In the general formulae (d-1) and (d-2), $R^{A1}$, $R^{A2}$ and $R^{A3}$ are each independently an alkenyl group having a mass-average molecular weight (Mw) of 500 to 3000 (preferably 900 to 2500).

Examples of the alkenyl groups capable of being selected as $R^{A1}$, $R^{A2}$ and $R^{A3}$ include a polybutenyl group, a polyisobutenyl group and an ethylene-propylene copolymer, and among these, a polybutenyl group or a polyisobutenyl group is preferable.

$R^{B1}$, $R^{B2}$ and $R_{B3}$ are each independently an alkylene group having 2 to 5 carbon atoms.

x1 is an integer of 0 to 10, preferably an integer of 1 to 4, and more preferably 2 or 3.

x2 is an integer of 1 to 10, preferably an integer of 2 to 5, and more preferably 3 or 4.

The compound represented by the general formula (d-1) or (d-2) may be a modified alkenyl succinimide obtained by reacting this compound with one or more selected from a boron compound, an alcohol, an aldehyde, a ketone, an alkylphenol, a cyclic carbonate, an epoxy compound and an organic acid.

In the lubricating oil composition of one embodiment of the present invention, the content of the ashless dispersant is preferably 0.01 to 10.0 mass %, more preferably 0.05 to 7.0 mass %, still more preferably 0.1 to 5.0 mass %, and still much more preferably 0.4 to 3.0 mass %, based on the total amount (100 mass %) of the lubricating oil composition.

<Metal-Based Detergent>

The lubricating oil composition of one embodiment of the present invention may further contain a metal-based detergent. The metal-based detergent may be used singly, or may be used in combination of two or more.

Examples of the metal-based detergents used in one embodiment of the present invention include metal salts, such as a metal sulfonate, a metal salicylate, and a metal phenate. The metal to constitute the metal salts is preferably a metal atom selected from alkali metals and alkaline earth metals, more preferably sodium, calcium, magnesium or barium, and still more preferably calcium.

In the lubricating oil composition of one embodiment of the present invention, the metal-based detergent preferably contains one or more selected from calcium sulfonate, calcium salicylate and calcium phenate, and more preferably contains calcium sulfonate.

The content of the calcium sulfonate is preferably 50 to 100 mass %, more preferably 60 to 100 mass %, still more preferably 70 to 100 mass %, and still much more preferably 80 to 100 mass %, based on the total amount (100 mass %) of the metal-based detergent contained in the lubricating oil composition.

The base number of the metal-based detergent is preferably 0 to 600 mgKOH/g.

In the lubricating oil composition of one embodiment of the present invention, however, the metal-based detergent is preferably an overbased metal-based detergent having a base number of 100 mgKOH/g or more.

The base number of the overbased metal-based detergent is 100 mgKOH/g or more, but it is preferably 150 to 500 mgKOH/g, and more preferably 200 to 450 mgKOH/g.

In the present specification, the "base number" means a base number measured by perchloric acid method in accordance with JIS K2501:2003 "Petroleum products and lubricants—Determination of neutralization number", 7.

In the lubricating oil composition of one embodiment of the present invention, the content of the metal-based detergent is preferably 0.1 to 10.0 mass %, more preferably 0.3 to 8.0 mass %, still more preferably 0.5 to 6.0 mass %, and still much more preferably 1.0 to 4.0 mass %, based on the total amount (100 mass %) of the lubricating oil composition.

In the lubricating oil composition of one embodiment of the present invention, the content of the metal-based detergent in terms of metal atoms is preferably 0.01 to 2.0 mass %, more preferably 0.03 to 1.5 mass %, still more preferably 0.05 to 1.0 mass %, and still much more preferably 0.1 to 0.8 mass %, based on the total amount (100 mass %) of the lubricating oil composition.

In the present specification, the content of metal atoms means a value measured in accordance with JPI-5S-38-92.

<Sulfur-Based Extreme Pressure Agent>

The lubricating oil composition of one embodiment of the present invention may further contain a sulfur-based extreme pressure agent. The sulfur-based extreme pressure agent may be used singly, or may be used in combination of two or more.

Examples of the sulfur-based extreme pressure agents used in one embodiment of the present invention include a thiadiazole-based compound, a polysulfide-based compound, a thiocarbamate-based compound, a sulfurized fat and oil-based compound, and a sulfurized olefin-based compound.

In the lubricating oil composition of one embodiment of the present invention, the content of the sulfur-based extreme pressure agent is preferably 0.001 to 3.0 mass %, more preferably 0.01 to 1.0 mass %, still more preferably 0.03 to 0.5 mass %, and still much more preferably 0.05 to 0.3 mass %, based on the total amount (100 mass %) of the lubricating oil composition.

In the lubricating oil composition of one embodiment of the present invention, the content of the sulfur-based extreme pressure agent in terms of sulfur atoms is preferably 10 to 1000 ppm by mass, more preferably 50 to 800 ppm by mass, still more preferably 100 to 600 ppm by mass, and still much more preferably 150 to 400 ppm by mass, based on the total amount (100 mass %) of the lubricating oil composition.

In the present specification, the content of sulfur atoms means a value measured in accordance with JIS K2541-6: 2013.

<Viscosity Index Improver>

The lubricating oil composition of one embodiment of the present invention may further contain a viscosity index improver. The viscosity index improver may be used singly, or may be used in combination of two or more.

Examples of the viscosity index improvers used in one embodiment of the present invention include olefin-based copolymers such as an ethylene-a-olefin copolymer, and polymethacrylates at least having a constituent unit derived from an alkyl acrylate or an alkyl methacrylate.

The weight-average molecular weight (Mw) of the viscosity index improver used in one embodiment of the present invention is preferably 5,000 to 100,000, more preferably 10,000 to 80,000, still more preferably 15,000 to 60,000, and still much more preferably 20,000 to 45,000.

In the present specification, the weight-average molecular weight (Mw) means a value measured by the method described in Examples.

In the lubricating oil composition of one embodiment of the present invention, the content of the viscosity index improver is preferably 0.01 to 20 mass %, more preferably 0.1 to 15 mass %, and still more preferably 1.0 to 10 mass %, based on the total amount (100 mass %) of the lubricating oil composition.

In the lubricating oil composition of one embodiment of the present invention, the total content of the components (A), (B) and (C) and the viscosity index improver is preferably 75 mass % or more, more preferably 80 mass % or more, still more preferably 85 mass % or more, still much more preferably 90 mass % or more, and particularly preferably 95 mass % or more, based on the total amount (100 mass %) of the lubricating oil composition. The total content thereof is usually 100 mass % or less, but taking the contents of other components into consideration, it may be 97.5 mass % or less.

The viscosity index improver described above and an anti-foaming agent, a pour point depressant, etc. described later are each often on the market in the form of a solution in which such a substance is dissolved in a diluent oil, taking handling properties and solubility in the base oil (A) into consideration.

In the present specification, however, in the case of the solution obtained by dilution with a diluent oil, the content of the viscosity index improver, the anti-foaming agent, the pour point depressant, or the like is a content expressed in terms of a resin to constitute the viscosity index improver, the anti-foaming agent, the pour point depressant, or the like, excluding the mass of the diluent oil.

<Anti-Foaming Agent>

The lubricating oil composition of one embodiment of the present invention may further contain an anti-foaming agent. The anti-foaming agent may be used singly, or may be used in combination of two or more.

Examples of the anti-foaming agents include methyl silicone oil, fluorosilicone oil, and polyacrylate.

In the lubricating oil composition of one embodiment of the present invention, the content of the anti-foaming agent is preferably 0.0001 to 2 mass %, and more preferably 0.001 to 1 mass %, based on the total amount (100 mass %) of the lubricating oil composition.

<Antioxidant>

The lubricating oil composition of one embodiment of the present invention may further contain an antioxidant. The antioxidant may be used singly, or may be used in combination of two or more.

Examples of the antioxidants used in one embodiment of the present invention include amine-based antioxidants, such as alkylated diphenylamine, phenylnaphthylamine, and alkylated phenylnaphthylamine; and phenol-based antioxidants, such as 2,6-di-t-butylphenol, 4,4'-methylenebis(2,6-di-t-butylphenol), isooctyl-3-(3,5-di-t-butyl-4-hydroxyphenyl)propionate, and n-octadecyl-3-(3,5-di-t-butyl-4-hydroxyphenyl)propionate.

In the lubricating oil composition of one embodiment of the present invention, it is preferable to use, as the antioxidant, a combination of an amine-based antioxidant and a phenol-based antioxidant.

In one embodiment of the present invention, the content ratio by mass of the amine-based antioxidant to the phenol-based antioxidant, [amine-based antioxidant/phenol-based antioxidant], is preferably 0.01 to 5.0, more preferably 0.05 to 2.0, still more preferably 0.10 to 1.0, and still much more preferably 0.12 to 0.9.

In the lubricating oil composition of one embodiment of the present invention, the content of the antioxidant is preferably 0.01 to 10 mass %, more preferably 0.05 to 5.0 mass %, and still more preferably 0.10 to 2.0 mass %, based on the total amount (100 mass %) of the lubricating oil composition.

<Other Lubricating Oil Additives>

The lubricating oil composition of one embodiment of the present invention may further contain other lubricating oil additives than the above-mentioned components when needed as long as the effects of the present invention are not impaired.

Examples of such lubricating oil additives include a pour point depressant, an extreme pressure agent other than the sulfur-based one, a demulsifier, a friction modifier, a corrosion inhibitor, a metal deactivator, and an antistatic agent.

These lubricating oil additives may be each used singly, or may be each used in combination of two or more.

The contents of these lubricating oil additives can be each appropriately adjusted as long as the effects of the present invention are not impaired, but the contents of the additives are each independently usually 0.001 to 10 mass %, preferably 0.005 to 5 mass %, and more preferably 0.01 to 1 mass %, based on the total amount (100 mass %) of the lubricating oil composition.

In the lubricating oil composition of one embodiment of the present invention, the content of a molybdenum atom-containing compound is preferably smaller. Specifically, in the lubricating oil composition of one embodiment of the present invention, the content of molybdenum atoms is preferably less than 100 ppm by mass, more preferably less than 50 ppm by mass, still more preferably less than 10 ppm by mass, and still much more preferably less than 2 ppm by mass, based on the total amount (100 mass %) of the lubricating oil composition.

In the present specification, the content of molybdenum atoms means a value measured in accordance with JPI-5S-38-92.

<Method for Producing Lubricating Oil Composition>

The method for producing a lubricating oil composition of one embodiment of the present invention is not particularly limited, but from the viewpoint of productivity, preferable is a method having a step of adding the aforementioned components (B) and (C) to the base oil (A).

In this step, it is preferable to add the aforementioned lubricating oil additives when needed, together with the components (B) and (C).

Here, the amounts of the components (A), (B) and (C), and the lubricating oil additives to be added are as previously described.

[Properties of Lubricating Oil Composition]

The kinematic viscosity of the lubricating oil composition of one embodiment of the present invention at 100° C. is preferably 1.5 $mm^2/s$ or more, more preferably 1.8 $mm^2/s$ or more, still more preferably 2.0 $mm^2/s$ or more, and still much more preferably 2.2 $mm^2/s$ or more, from the viewpoint of suppressing evaporation loss, and it is preferably 6.5

$mm^2/s$ or less, more preferably 6.2 $mm^2/s$ or less, still more preferably 6.0 $mm^2/s$ or less, still much more preferably 5.8 $mm^2/s$ or less, and particularly preferably 5.6 $mm^2/s$ or less, from the viewpoint of obtaining a lubricating oil composition excellent in fuel saving properties.

The viscosity index of the lubricating oil composition of one embodiment of the present invention is preferably 80 or more, more preferably 90 or more, still more preferably 100 or more, and still much more preferably 110 or more.

Regarding the lubricating oil composition of one embodiment of the present invention, a load stage that is measured under the conditions of Examples described later in accordance with ASTM D5182-97 when scoring has occurred is preferably 8 or more, more preferably 9 or more, still more preferably 10 or more, and still much more preferably 11 or more.

Regarding the lubricating oil composition of one embodiment of the present invention, an average value (Shell wear volume) of wear mark diameters of three ½-inch balls after the Shell wear test that is carried out under the conditions of Examples described later in accordance with ASTM D2783 is preferably 0.65 mm or less, more preferably 0.60 mm or less, still more preferably 0.50 mm or less, still much more preferably 0.45 mm or less, and particularly preferably 0.40 mm or less.

[Use Application of Lubricating Oil Composition]

The lubricating oil composition of one preferred embodiment of the present invention has good fuel saving properties and is excellent in seizure resistance and wear resistance.

Taking such characteristics into consideration, the lubricating oil composition of one embodiment of the present invention can be preferably used for lubrication in mechanisms, such as a torque converter, a wet clutch, a gear bearing mechanism, an oil pump and a hydraulic control mechanism, which are incorporated in various apparatuses, such as an engine, a transmission, a speed reducer, a compressor and a hydraulic system, but the composition is particularly preferably used for lubrication of a speed reducer.

When the aforementioned characteristics of the lubricating oil composition of one embodiment of the present invention are taken into consideration, the present invention can also provide the following [1] and [2].

[1] A speed reducer using a lubricating oil composition comprising a base oil (A), a zinc dialkyldithiophosphate (B), and a sarcosine derivative (C).

[2] Use of a lubricating oil composition, in which a lubricating oil composition comprising a base oil (A), a zinc dialkyldithiophosphate (B), and a sarcosine derivative (C) is applied to lubrication of a speed reducer.

EXAMPLES

Next, the present invention will be described in much more detail with reference to Examples, but the present invention is in no way limited to these Examples. Measuring methods for various properties are as follows.

(1) Kinematic Viscosity, Viscosity Index

The kinematic viscosity and viscosity index were measured and calculated in accordance with JIS K2283:2000.

(2) Contents of Zinc Atoms, Phosphorus Atoms, Calcium Atoms, and Molybdenum Atoms The contents were measured in accordance with JPI-5S-38-92.

(3) Content of Sulfur Atoms

The content was measured in accordance with JIS K2541-6:2013.

(4) Base Number (Perchloric Acid Method)

The base number was measured in accordance with JIS K2501:2003 (perchloric acid method).

(5) Weight-Average Molecular Weight (Mw)

Using a gel permeation chromatograph apparatus (manufactured by Agilent Technologies, Inc., "1260 model HPLC"), the weight-average molecular weight was measured under the following conditions, and a value measured in terms of standard polystyrene was used.

(Measurement Conditions)

Column: sequentially connected two of "Shodex LF404".

Column temperature: 35° C.

Developing solvent: chloroform

Flow rate: 0.3 mL/min (6) Base Number

The base number was measured by perchloric acid method in accordance with JIS K2501:2003 "Petroleum products and lubricants—Determination of neutralization number", 7.

Examples 1 to 4, Comparative Examples 1 to 4

A base oil and various additives of types shown in Table 1 were added and mixed in amounts shown in Table 1, thereby preparing each lubricating oil composition.

Details of each component used in the preparation of the lubricating oil composition are as follows. In any of the lubricating oil compositions, the content of molybdenum atoms was less than 2 ppm by mass.

<Component (A): Base Oil>

"Mineral oil (1)": hydrocracked mineral oil, 100° C. kinematic viscosity=2.7 $mm^2/s$, viscosity index=111.

"Mineral oil (2)": hydrocracked mineral oil, 100° C. kinematic viscosity=4.1 $mm^2/s$, viscosity index=125.

"PAO (1)": poly-α-olefin, 100° C. kinematic viscosity=1.8 $mm^2/s$.

"PAO (2)": poly-α-olefin, 100° C. kinematic viscosity=100 $mm^2/s$, viscosity index=170.

<Component (B) : ZnDTP>

ZnDTP: secondary zinc dialkyldithiophosphate; compound represented by the aforementioned general formula (b-1) wherein all of $R^1$ to $R^4$ are groups represented by the aforementioned general formula (ii); zinc atom content=9.0 mass %, phosphorus atom content =8.2 mass %, sulfur atom content=17.1 mass %. <Component (C): sarcosine derivative>

Oleoyl sarcosine: compound of the aforementioned general formula (c-1) wherein R is an heptadecenyl group (C17)

<Oily agent>

Oleyl alcohol

Oleylamine

<Various Additives>

Ashless dispersant: non-modified polybutenyl bis-succinimide having a butenyl group of Mw=950.

Ca-based detergent: overbased calcium sulfonate, base number (perchloric acid method)=405 mgKOH/g, calcium atom content=15.2 mass %.

Sulfur-based extreme pressure agent: thiadiazole, sulfur atom content=35 mass %.

Viscosity index improver: solution having a resin concentration of 42 mass % obtained by diluting polymethacrylate of Mw=30,000 with a diluent oil.

Amine-based antioxidant: alkylated diphenylamine.

Phenol-based antioxidant: hindered phenol.

Anti-foaming agent: silicone-based anti-foaming agent (solution having a resin concentration of 1.0 mass % obtained by dilution with a diluent oil)

Regarding the lubricating oil compositions prepared, the kinematic viscosity and viscosity index were measured or calculated, and the following test was carried out. The results of them are set forth in Table 1.

(1) FZG Scuffing Test (A10/16.6R/90)

A load was stepwise increased based on the regulations using an A10 type gear under the conditions of a sample oil temperature of 90° C., a rotational speed of 2880 rpm and an operating time of 15 minutes in accordance with ASTM D5182-97, and when scoring occurred, a stage of the load was determined. It can be said that the larger the value of the stage is, the better the seizure resistance of the lubricating oil composition becomes. In the present examples, when the stage was 8 or more, the seizure resistance was judged to be "pass".

(2) Shell Wear Test

Shell wear test was carried out using a four-ball tester under the test conditions of a load of 490 N, a rotational speed of 1,800 rpm, an oil temperature of 120° C., and a testing time of 30 minutes in accordance with ASTM D2783. After the test, an average value of wear mark diameters of three ½-inch balls was calculated as "Shell wear volume". It can be said that the smaller the value is, the better the wear resistance of the lubricating oil composition becomes. In the present examples, when the average value (Shell wear volume) of the wear mark diameters was 0.65 mm or less, the wear resistance was judged to be "pass".

The invention claimed is:

1. A lubricating oil composition, comprising:

a base oil (A);

a zinc dialkyldithiophosphate (B) of formula (b-1):

(b-1)

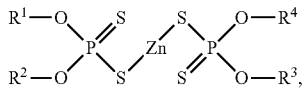

$R^1$ to $R^4$ independently being a hydrocarbon group; and a sarcosine derivative (C) of formula (c-1):

(c-1)

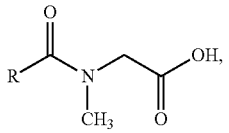

R being a hydrocarbon group having 6 to 30 carbon atoms, wherein the zinc dialkyldithiophosphate (B) is present in a range of from 0.10 to 10 mass %, based on total lubricating oil composition mass, wherein the sarcosine derivative (C) is present in a range of from 0.01 to 5.0 mass %, based on the total lubricating oil composition mass, and wherein the lubricating oil composition has a molybdenum atom content of less than 10 ppm by mass, based on the total lubricating oil composition mass.

TABLE 1

| | | | | Ex. 1 | Ex. 2 | Ex. 3 | Ex. 4 | Comp. Ex. 1 | Comp. Ex. 2 | Comp. Ex. 3 | Comp. Ex. 4 |
|---|---|---|---|---|---|---|---|---|---|---|---|
| Formulation of lubricating oil composition | Component (A) | Mineral oil (1) | mass % | 52.62 | 78.62 | 92.62 | — | 79.12 | 78.62 | 78.62 | 80.32 |
| | | Mineral oil (2) | mass % | 30.00 | — | — | — | — | — | — | — |
| | | PAO(1) | mass % | — | — | — | 92.62 | — | — | — | — |
| | | PAO(2) | mass % | — | 6.50 | — | — | 6.50 | 6.50 | 6.50 | 6.50 |
| | Component (B) | ZnDTP | mass % | 1.70 | 1.70 | 1.70 | 1.70 | 1.70 | 1.70 | 1.70 | — |
| | Component (C) | Oleoyl sarcosine | mass % | 0.50 | 0.50 | 0.50 | 0.50 | — | — | — | 0.50 |
| | Oily agent | Oleyl alcohol | mass % | — | — | — | — | — | 0.50 | — | — |
| | | Oleylamine | mass % | — | — | — | — | — | — | 0.50 | — |
| | Various additives | Ashless dispersant | mass % | 1.00 | 1.00 | 1.00 | 1.00 | 1.00 | 1.00 | 1.00 | 1.00 |
| | | Ca-based detergent | mass % | 2.60 | 2.60 | 2.60 | 2.60 | 2.60 | 2.60 | 2.60 | 2.60 |
| | | Sulfur-based extreme pressure agent | mass % | 0.08 | 0.08 | 0.08 | 0.08 | 0.08 | 0.08 | 0.08 | 0.08 |
| | | Viscosity index improver (*1) | mass % | 10.00 | 7.50 | — | — | 7.50 | 7.50 | 7.50 | 7.50 |
| | | Amine-based antioxidant | mass % | 0.20 | 0.20 | 0.20 | 0.20 | 0.20 | 0.20 | 0.20 | 0.20 |
| | | Phenol-based antioxidant | mass % | 1.00 | 1.00 | 1.00 | 1.00 | 1.00 | 1.00 | 1.00 | 1.00 |
| | | Anti-foaming agent (*2) | mass % | 0.30 | 0.30 | 0.30 | 0.30 | 0.30 | 0.30 | 0.30 | 0.30 |
| | Total | | mass % | 100.00 | 100.00 | 100.00 | 100.00 | 100.00 | 100.00 | 100.00 | 100.00 |
| Component (B)/Component (C) | | | — | 3.40 | 3.40 | 3.40 | 3.40 | — | — | — | — |
| Various properties | 40° C. kinematic viscosity | | $mm^2/s$ | 18.0 | 18.0 | 10.8 | 6.3 | 17.8 | 17.9 | 17.9 | 17.6 |
| | 100° C. kinematic viscosity | | $mm^2/s$ | 4.6 | 4.6 | 2.9 | 2.0 | 4.6 | 4.6 | 4.6 | 4.6 |
| | Viscosity index | | — | 186 | 186 | 120 | 107 | 190 | 188 | 188 | 194 |
| Various tests | FZG scuffing test (A10/16.6R/90), Load stage | | — | 11 | 11 | 10 | 10 | 10 | 10 | 10 | 6 |
| | Shell wear test, Wear mark diameter | | mm | 0.34 | 0.34 | 0.37 | 0.39 | 0.68 | 0.73 | 0.69 | 0.42 |

(*1): This represents the amount of a solution added having a resin concentration of 42 mass % obtained by dilution with a diluent oil.

(*2): This represents the amount of a solution added having a resin concentration of 1.0 mass % obtained by dilution with a diluent oil.

From Table 1, the seizure resistance and the wear resistance of the lubricating oil compositions of Examples 1 to 4 proved to be good despite the low viscosities. On the other hand, the results for the lubricating oil compositions of Comparative Examples 1 to 3 were inferior in wear resistance. The result for the lubricating oil composition of Comparative Example 4 was inferior in seizure resistance.

2. The composition of claim 1, having a kinematic viscosity at 100° C. is of 6.5 $mm^2/s$ or less.

3. The composition of claim 1, comprising the zinc dialkyldithiophosphate (B) in a range of from 1.0 to 5.0 mass %, based on the total lubricating oil composition mass.

4. The composition of claim 1, comprising the sarcosine derivative (C) in a range of from 0.10 to 3.0 mass %, based on the total lubricating oil composition mass.

5. The lubricating oil composition of claim 1, wherein a (B)/(C) mass ratio of the zinc dialkyldithiophosphate (B) to the sarcosine derivative (C) is in a range of from 1.0 to 10.0.

6. The composition of claim 1, wherein in the zinc dialkyldithiophosphate (B), $R^1$ to $R^4$ are each independently a C1 to C20 hydrocarbon group.

7. The composition of claim 1, wherein at least one of $R^1$ to $R^4$ in formula (b-1) is a group of formula (i) or (ii):

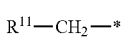

(i)

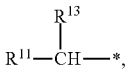

(ii)

wherein $R^{11}$ to $R^{13}$ are each independently an alkyl group, and

* is a bonding position to an oxygen atom in the formula (b-1).

8. The composition of claim 1, wherein, in the sarcosine derivative (C),

R is an alkenyl group.

9. The composition of claim 1, wherein, in the sarcosine derivative (C), R is an alkyl group.

10. A method of lubricating a reduction drive, the method comprising:

contacting the reduction drive with the lubricating oil composition of claim 1.

11. A method for producing the lubricating oil composition of claim 1. the method comprising:

adding the zinc dialkyldithiophosphate and the sarcosine derivative to the base oil.

12. The composition of claim 1, wherein, in the zinc dialkyldithiophosphate (B), $R^2$ to $R^4$ are each independently a C1 to C20 hydrocarbon group.

13. The composition of claim 1, wherein, in the zinc dialkyldithiophosphate (B), $R^1$ to $R^4$ are each independently a C3 to C12 hydrocarbon group.

14. The composition of claim 1, wherein, in the sarcosine derivative (C), R is a hexenyl, heptenyl, octenyl, nonenyl, decenyl, undecenyl, dodecenyl, a tridecenyl, tetradecenyl, hexadecenyl, heptadecenyl, tetracosenyl, or hexacosenyl group.

15. The composition of claim 1, wherein, in the sarcosine derivative (C), R is a C12 to C20 alkenyl group.

16. The composition of claim 1, wherein the sarcosine derivative (C) comprises N-lauryl sarcosine, N-oleyl sarcosine, N-lauroyl sarcosine, N-oleoyl sarcosine, N-myristoyl sarcosine, N-palmitoyl sarcosine, N-stearoyl sarcosine, undecanoyl sarcosine, tridecanoyl sarcosine, and/or pentadecanoyl sarcosine.

17. The composition of claim 16, wherein the sarcosine derivative (C) is present in a range of from 0.25 to 1.5 mass %, based on the total lubricating oil composition mass, and wherein a (B)/(C) mass ratio of the zinc dialkyldithiophosphate (B) to the sarcosine derivative (C) is in a range of from 2.5 to 5.0.

18. The composition of claim 17, having a total content of the base oil (A), the zinc dialkyldithiophosphate (B), and the sarcosine derivative (C) of at least 80 mass %, based on the total lubricating oil composition mass.

19. The composition of claim 17, having a total content of the base oil (A), the zinc dialkyldithiophosphate (B), and the sarcosine derivative (C) in a range of from 80 to 95 mass %, based on the total lubricating oil composition mass.

20. The composition of claim 19, wherein the base oil (A) is present in a range of from 80 to 95 mass %, based on the total lubricating oil composition mass, and wherein the zinc dialkyldithiophosphate (B) is present, in terms of zinc atoms, in a range of from 0.12 to 0.40 mass %, based on the total lubricating oil composition mass.

* * * * *